United States Patent [19]

Chase

[11] 3,987,569

[45] *Oct. 26, 1976

[54] ADHESIVE PICTURE MOUNT

[76] Inventor: Marston Chase, 1330 New Hampshire Ave. NW., Washington, D.C. 20036

[ * ] Notice: The portion of the term of this patent subsequent to July 8, 1992, has been disclaimed.

[22] Filed: May 30, 1975

[21] Appl. No.: 582,156

Related U.S. Application Data

[60] Continuation of Ser. No. 452,554, March 19, 1974, Pat. No. 3,893,252, which is a continuation of Ser. No. 877,583, Nov. 26, 1969, abandoned, which is a division of Ser. No. 690,858, Dec. 15, 1967, Pat. No. 3,517,106.

[52] U.S. Cl. ..... 40/158 R

[51] Int. Cl.[2] ..... G09F 1/10

[58] Field of Search ..... 40/158 R, 125 A, 135; 156/249, 230

[56] References Cited

UNITED STATES PATENTS

| | | | |
|---|---|---|---|
| 1,261,133 | 4/1918 | Kidd | 40/158 R |
| 2,598,755 | 6/1952 | Birch | 40/158 R |
| 2,603,899 | 7/1952 | Leander | 40/125 A |
| 2,737,745 | 3/1956 | Hartmann | 40/158 R |
| 3,024,553 | 3/1962 | Rowley | 40/158 R |
| 3,304,641 | 2/1967 | Gonczy | 40/158 R |
| 3,381,402 | 5/1968 | Ohfuji | 40/158 R |
| 3,503,835 | 3/1970 | Hermann | 40/158 R X |
| 3,505,140 | 4/1970 | Dunn | 156/249 |
| 3,517,106 | 6/1970 | Chase | 40/125 A X |
| 3,687,770 | 8/1972 | Chase | 40/158 R |
| 3,893,252 | 7/1975 | Chase | 40/158 R |

FOREIGN PATENTS OR APPLICATIONS

| | | | |
|---|---|---|---|
| 238,852 | 1/1960 | Australia | 40/125 A |
| 987,005 | 3/1965 | United Kingdom | 40/158 R |

*Primary Examiner*—Louis G. Mancene
*Assistant Examiner*—John H. Wolff
*Attorney, Agent, or Firm*—Dennison, Dennison, Meserole & Pollack

[57] ABSTRACT

A mount for mounting pictures and the like in accurate position including a base with a layer of adhesive on one or both surfaces and with a sectional release sheet overlying the adhesive, the release sheet material being sufficiently thick where a section is removed so that one or more sections can be removed and the picture to be mounted can be moved about on the remainder of the release sheet without adhesively contacting the exposed adhesive until the picture is accurately positioned on the mount, at which time the picture is pressed into contact with the exposed adhesive, and the remainder of the release sheet is removed and the picture is progressively pressed into adhesive contact with the remainder of the adhesive in a direction away from the previously exposed adhesive to provide a wrinkle-free bubble-free bond.

2 Claims, 19 Drawing Figures

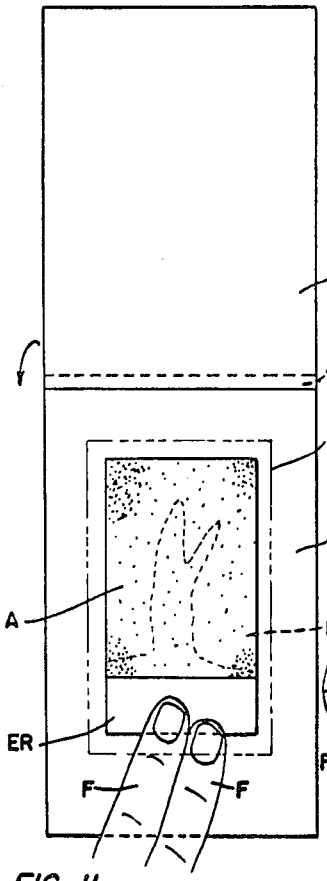
FIG. 11
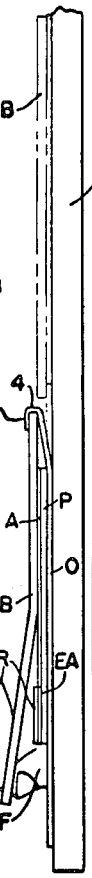
FIG. 12
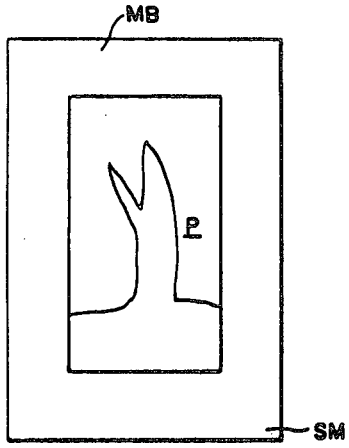
FIG. 13
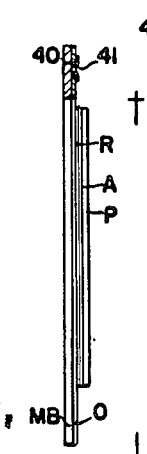
FIG. 15
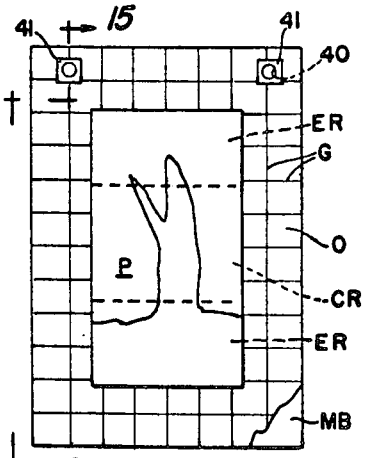
FIG. 14
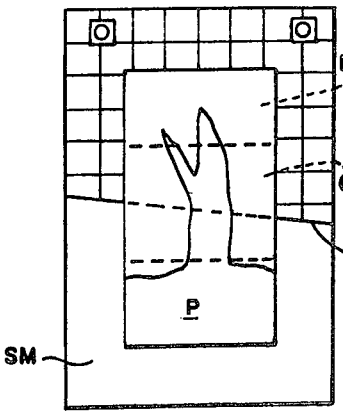
FIG. 16
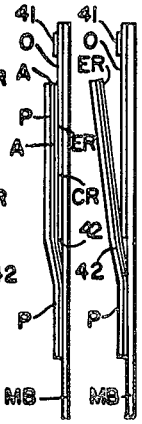
FIG. 17
FIG. 18

ADHESIVE PICTURE MOUNT

This is a continuation of application Ser. No. 452,554, filed Mar. 19, 1974, now U.S. Pat. No. 3,893,252. Ser. No. 452,554 is a continuation of Ser. No. 877,583, filed Nov. 26, 1969, now abandoned, which is in turn a division of Ser. No. 690,858, filed Dec. 15, 1967, now U.S. Pat. No. 3,517,106.

The present invention relates generally to methods and means of mounting pictures, such as illustrations, photographic prints, post cards, newspaper clippings, and the like on mounting boards, album pages, and other opaque or transparent supports. More particularly, the invention relates to methods of smoothly adhering pictures to mounts or supports that include a layer of pressure-sensitive adhesive and to means for mounting pictures in accurate location on supports.

Heretofore, various methods and means have been devised for permanently mounting pictures on supports, and they include a variety of adhesives and devices. Liquid adhesives are messy, frequently damage the pictures or supports, and require considerable skill and care in their use; adhesives that must be moistened have to be applied commercially; and mounting tissues require prolonged heat and pressure applied with specialized equipment. Pressure-sensitive adhesives have been used, but it has proved to be extremely difficult to mount a picture properly with these adhesives since heretofore there has been no provision for preventing accidental contact between the picture and the adhesive while the picture was being positioned on the mount, and any attempt to move the picture after accidental contact damaged the picture and/or the adhesive. Furthermore, in the past it has generally been necessary to carefully measure and draw construction lines on the face of a support in order to assure that a picture would be properly located and aligned on the support and such construction lines could not be completely removed.

An object of the present invention is to provide methods and means for unskilled users to mount any picture smoothly and in accurate location on a support and which overcome the difficulties of the prior art.

A further object of the invention is to provide methods and means for smoothly securing a picture to a layer of pressure-sensitive adhesive.

A further object is to provide methods and means for smoothly adhering a picture, mat, mat liner, and other mounting elements in accurate location on a mount or support that is coated with pressure-sensitive adhesive.

A further object is to provide a pressure-sensitive adhesive layer on a picture or support with means for guiding the picture into precise location with relation to the support without any adherence and thereafter causing adherence between the picture and the support.

A further object is to provide means for mounting an adhesive-backed picture in accurate location on a support, such as a mounting board that is larger than the picture, without having to draw guide lines on the support, so that the area of the mounting board that extends outside the area of the picture is unmarked and can serve as a self-mat.

Other and further objects will be apparent as the description proceeds and upon reference to the accompanying drawings wherein:

FIG. 11 is a plan view of a mounting board with an oversheet hingedly connected along one edge and having guide lines observable on the surface of the oversheet facing the mounting board with a picture face down properly located by the guide lines and the picture having adhesive on its back partially covered by a release sheet;

FIG. 12 is a side view of the mounting board and oversheet of FIG. 11 on a horizontal surface such as a table with the mounting board shown in phantom lines in open position and shown in full lines in the closed position after partial securement to the picture and prior to removal of the remainder of the release sheet;

FIG. 13 shows the picture fixed to the mounting board support shown in FIGS. 11 and 12 with the mounting board serving as a self mat around the margins of the picture;

FIG. 14 is a plan view illustrating an oversheet releasably attached to a mounting board with guide lines on the front of the oversheet and a picture secured to a mount positioned thereon;

FIG. 15 is a section taken along line 15—15 of FIG. 14 showing the means of temporary attachment of an oversheet to a mounting board or support;

FIG. 16 shows the lower portion of the oversheet removed from the mounting board or support and the lower portion of the release sheet removed from the picture mount and with the lower portion of the picture with its mount adhering to the mounting board or support;

FIG. 17 is a side elevation of the partially mounted picture of FIG. 16; and FIG. 18 illustrates how the remainder of the picture can be adhered to the mount by raising the unadhered portion of the picture and removing the remainder of the oversheet and release sheet.

Figure 1:
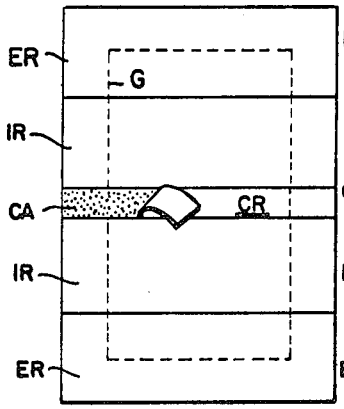
FIG. 1 is a plan view of a picture mount that includes a layer of adhesive on both surfaces of a web, with the adhesive covered by release sheets that have picture-locating guide lines on their surfaces and that are divided into sections, with a narrow release sheet section across the center of the mount.

Briefly, the present invention provides a picture mount that includes a layer of pressure-sensitive adhesive with one surface covered by a release sheet that generally is divided into a plurality of separable sections and with the other surface covered by a similar release sheet or adhered to a base, so that upon removal of one or more of the release sheet sections from one side of the mount, a picture can be positioned on the remainder of the release sheet without contacting the exposed adhesive. After the picture is in the proper position in relation to the mount, it is pressed into contact with the section of exposed adhesive and then, as the remaining release sheet sections are removed outwardly from the first uncovered section of adhesive, the remainder of the picture is progressively pressed smoothly into adhesive contact with the remainder of the adhesive without wrinkles or bubbles.

If the mount is the type that has release sheets on both surfaces, the combined picture and mount are now ready to be mounted on a support, either in the same manner that the picture was secured to the mount or by means of a mounting board with attached oversheet that receives the picture and mount for transfer to the mounting board.

If the mount is the type that includes a base and is the same size as the picture, the picture is now ready for framing or other means of display. However, by using a mount that is larger than the picture, other mounting elements such as a mat and mat liner can be secured to the adhesive that extends beyond the margins of the picture, at the same time and in the same manner that the picture is secured to the mount.

A modification of this mount includes a transparent base and adhesive, so that a picture can be mounted in face contact with the adhesive and viewed through the base.

In other forms of the mount, the web or base may be a picture or material that a picture can be printed on, and the web or base may also be a mounting board.

Guide lines on the mounts or guide elements that are not part of the mounts are used to position and align the pictures on the mounts and supports.

The web or base may be plastic, paper, cardboard, or other suitable material; the adhesive may be a layer on one or both surfaces of the web or base or may be a single layer of adhesive; and the cover release sheets may be silicone treated paper, waxed paper, or any other suitable material that adheres lightly to the adhesive.

Referring more particularly to the drawings, the mounts shown in FIGS. 1 to 5 include a layer of pressure-sensitive adhesive A to which the picture P is adhered preparatory to mounting the picture on a support. The mounts embody the principle that by uncovering and/or exposing only a small or narrow area of adhesive, a picture can be placed over the remainder of the adhesive layer which is protected from unintentional contact by a release sheet and the picture can be moved freely over the area of exposed adhesive without contacting the adhesive while the picture is guided into accurate location on the mount, since the remaining release sheet keeps the picture above the surface of the exposed adhesive until it is desired to press the picture into contact with the adhesive. The adhesive layer comprises a web W of tissue-thin material with adhesive A on both surfaces thereof covered by release sheets R, R that are made of a number of easily separable sections, with at least one narrow section. Guide lines G may be provided on one or both release sheets and/or on the web for use in accurately positioning a picture on the mount.

Figure 2:
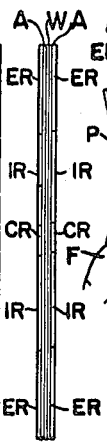
FIG. 2 is a side elevation of the mount of FIG. 1 showing the construction of the mount, with the thickness exaggerated.
Figure 3:
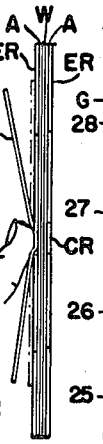
FIG. 3 is a side elevation of a picture overlying the mount of FIG. 1 with the narrow central release sheet section removed from one side of the mount showing the central portion of a picture being pressed by digital pressure into adhesive contact with the uncovered section of the adhesive.

When a picture is to be secured to the mount of FIGS. 1 to 3, the mount preferably is placed on a horizontal surface such as a table top and the central release sheet section CR is removed from one side of the mount as in FIG. 1 and the picture P placed on the mount contacting only the remainder of the release sheet sections IR, IR, ER, ER so the picture can be moved about freely without contacting the exposed adhesive CA, as illustrated by the dash-dot lines in FIG. 3. After the picture is accurately located and aligned in relation to the mount and the guide lines G, the user presses his fingers F against the portion of the picture overlying the exposed adhesive CA and presses that portion of the picture into adhering contact with the adhesive A as in FIG. 3, thereby retaining the picture in accurate location. If the mount is larger than the picture, it may now be trimmed to the size desired by cutting along the guide lines or the edges of the picture. By trimming the mount at this time, before the adhesive is completely uncovered or exposed, the release sheet R prevents most of the adhesive from contacting and adhering to the blades of the scissors, thereby facilitating the trimming. The release sheet sections IR, IR and ER, ER are then progressively removed from the same side of the mount and the picture progressively pressed into contact with the adhesive, working from the center outwardly to the edges of the picture, thereby fixing the picture smoothly to the mount throughout the entire area of the picture without bubbles or wrinkles.

Figure 10:
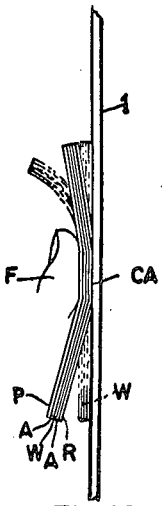
FIG. 10 illustrates in side elevation how a picture and its mount of FIGS. 1 to 3 are located on a support such as a page of a photograph album or a mounting board by removing the central release sheet section from the back of the mount and pressing the exposed adhesive into contact with the support.

After the picture is secured to the mount, the picture with its mount is ready for mounting on a support, such as a page 1 of a photograph album shown in FIG. 10, in a manner similar to that by which the picture was secured to the mount. The picture P with its mount secured thereto is placed on the album page support 1 after the center portion CA of the adhesive A has been uncovered by removal of release sheet section CR from the back of the mount, but the exposed or uncovered adhesive CA does not contact the support 1, as shown in phantom outline in FIG. 10 due to the stiffness of the picture and mount, the thickness of the remaining release sheet sections, and the relatively narrow width between the adjacent remaining release sheet sections IR and IR. The picture and mount are then moved to the proper location and depressed in the central portion until the central portion CA of the adhesive contacts the support 1 and fixes the picture and mount in final position. The remaining release sheet sections IR, IR and ER, ER are progressively removed by bending the picture P and its mount outward away from support 1 as shown by phantom lines in FIG. 10 and in full lines in FIG. 10A to produce a curved contour that produces stresses so the abutting edges of the release sheet sections move away from the adhesive A, thereby enabling the user to grip the release sheet sections and separate them from the adhesive by a peeling and pulling action. As each section of the release sheet is removed outwardly from the first area CA of exposed adhesive, the picture with its mount is progressively pressed smoothly into contact with the support. The picture and its mount may also be mounted on a support such as a mounting board by this method or by means of mounting devices described below.

The provision of multiple release sheet sections IR and ER between the initially removed narrow release sheet section, in this instance the central section CR, and the remote end or ends of the mount has been found to be of particular significance. The multiple sections furnish a means of removing the remainder of the release sheet R from a point between the initially adhered portion of the picture and the end or ends of the mount subsequent to an adhering of the picture with the adhesive in area CA, rather than having to turn the picture back sharply to expose the edge of the release sheet adjacent the adhered portion of the picture if only a single, wide section were provided, as in FIG. 6, and if that edge of the release sheet section were raised first for removal of the section. This also avoids the difficulties inherent in removing a single, wide release sheet section if the edge of the section were raised first at the end or ends of the mount, especially if the end or ends of the mount were at any great distance from the narrow section. The removal of the innermost section IR is effected by first raising the outer edge thereof adjacent section ER and lifting section IR free from the adhesive. The removal of section ER is then effected by raising the edge adjacent the area of adhesive exposed by the removal of section IR and peeling the section outward toward, and off, the end of the mount. This, in turn, prevents the exposure of a wide area of adhesive before the picture is adhered, as the provision of multiple release sheet sections makes possible incremental removal of the release sheet sections progressively outward from the initially exposed adhesive area subsequent to an adhering of the picture with the initially exposed adhesive, thereby assuring a gradual and progressive outward exposure of the adhesive and substantially facilitating the smooth adherence of the picture throughout the entire area thereof. Were, on the contrary, the entire large adhesive area exposed subsequent to the initial adhesive orientation of the picture, difficulties could be encountered both in removing the release sheet and in smoothly adhering the remainder of the picture. Such difficulties are avoided by the use of multiple additional independent release sections between the initially removed section and the end or ends of the mount. Such an arrangement is clearly illustrated in FIG. 1 and discussed supra and FIGS. 4 and 9 to be discussed subsequently.

Mounting devices illustrated in FIGS. 11 to 13 and 14 to 18 are used for mounting a combined picture and mount of the present invention in accurate location on a mounting board so the picture can be mounted with the marginal portions of the mounting board providing a self-mat without having to draw guide lines on the mounting board. Both devices have removable oversheets with guide lines on which the picture with its mount is positioned and from which the picture with its mount can be transferred to the mounting board automatically in accurate location and with the marginal portions of the mounting board that extend outside the area of the picture forming a self-mat.

Referring to FIGS. 11 and 12, a removable oversheet O having guide lines G observable on its face is hingedly connected face to face with a mounting board MB by having an end portion of the oversheet O secured to the back of the mounting board MB so the oversheet O can extend away from the board. The overhsheet is the same width as the mounting board but longer than the mounting board to extend beyond the free end of the mounting board when the mounting board MB and oversheet are closed together in the manner of pages of a book. Guide lines are located on the oversheet within an area that corresponds to the area of the mounting board. In use, the oversheet and mounting board are opened apart like the pages of a book on a flat surface such as table top T. The major portion of the release sheet R is removed from the back of a mount to which a picture is secured in the manner of FIGS. 1 to 3 and the picture P with adhesive A on its back partially covered by a release sheet section ER is placed face down on the face of the oversheet O in proper position by means of the guide lines G, the release sheet permitting the user to place his fingers F thereon to move the picture into accurate location on the guide lines without having his fingers F adhere to the adhesive. After correct positioning, the mounting board MB is swung about its hingedly connected end onto the oversheet O in the manner of closing a book while the oversheet is kept taut by pressure of the user's fingers F on the extension of the oversheet and by pressure exerted on the mounting board toward the hinge connection and the mounting board is caused to contact the adhesive on the back of the picture and mount progressively from the hinge end, thus adhering the picture to the mounting board. The oversheet O is then removed from the mounting board and discarded and the remaining release sheet section ER is removed from the back of the mount, and the remainder of the adhesive EA on the back of the picture and mount is pressed into smooth contact with the mounting board, thus mounting the picture in accurate location on the mounting board leaving a self-mat SM around the picture, as shown in FIG. 13.

FIGS. 14 to 18 illustrates a releasably attached oversheet O superimposed on a mounting board MB and with guide lines G on its face. One means of releasably attaching the oversheet without marring the face of the board includes apertures 40 through the oversheet at one end covered by pressure-sensitive adhesive tape 41 which adheres to the oversheet O and secures the oversheet to the mounting board MB by the portions of the tape extending through the apertures 40 in the oversheet O to the mounting board MB (FIG. 15). When mounting a picture that is secured to a mount in the manner of FIGS. 1 to 5 inclusive, the picture P is placed face up on the face of the oversheet O and the proper location for the picture determined on the guide lines G, as in FIG. 14. The picture is then removed, the oversheet is severed adjacent the middle of the length of the area that the picture will occupy, and the free portion of oversheet is removed, leaving an edge 42. A section of release sheet ER that is shown narrower than half the length of the picture is then removed from the back of the mount, the picture is returned to its position on the guide lines of the oversheet with the portion of the picture with adhesive exposed on its back extending beyond the edge of the oversheet and overlying but not contacting the face of the mounting board, and while the portion of the picture that overlies the remainder of the oversheet is kept in accurate location on the guide lines, the portion of the picture with adhesive exposed on its back that now overlies the exposed portion of the mounting board is smoothly pressed into contact with the mounting board as in FIGS. 16 and 17. Then the portion of the picture that overlies the remainder of the oversheet is lifted away from the oversheet, as in FIG. 18, the remainder of the oversheet O and release sheet sections CR and ER removed and the remainder of the picture pressed into contact with the mounting board thereby providing a picture for display leaving a self-mat around the picture.

Figure 4:
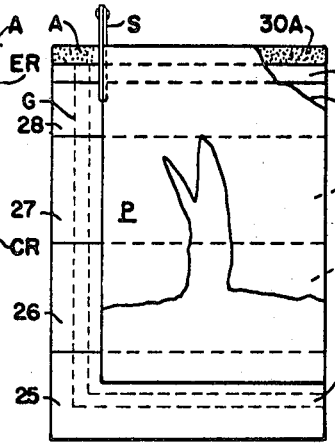
FIG. 4 is a modification of the mount of FIG. 1 with narrow release sheet sections adjacent one end, with one narrow release sheet section removed from one side of the mount and a picture overlying the mount with one end of the picture overlying the uncovered adhesive and also showing guide lines on two adjacent edge portions of the release sheet.
Figure 5:
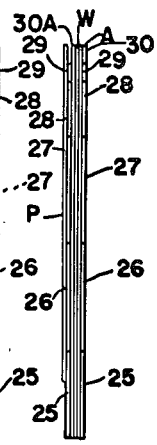
FIG. 5 is a side elevation of the mount of FIG. 4 showing how the one end of the picture is maintained spaced from the uncovered and exposed adhesive section by the relative thickness of the adjacent release sheet section and the relative stiffness of the picture.

FIGS. 4 and 5 illustrate a mount that is a similar to that of FIGS. 1 to 3, but with narrow release sheet sections 29 and 30 at one end of the mount and a plurality of wide release sheet sections 25, 26, 27 and 28.

In securing a picture to the mount, the end release sheet section 30 is removed from one side of the mount if the picture is on thin material, or both narrow end release sheet sections 29 and 30 are removed if the picture is on thick material, the picture P is placed on the remainder of the release sheet R including sections 25 to 29 or 25 to 28 respectively and aligned on the guide lines G as in FIG. 4, with one end of the picture overlying but not contacting the exposed adhesive A as in FIG. 5, the end of the picture overlying the exposed adhesive is pressed into contact with it as in a manner similar to that of FIG. 3 and the mount is trimmed by scissors S if necessary, and the sections 29 to 25 or 28 to 25 of the release sheet respectively are progressively removed and the picture progressively pressed into smooth contact with the adhesive. The picture and its mount are then ready for mounting on a support as previously described.

Figure 6:
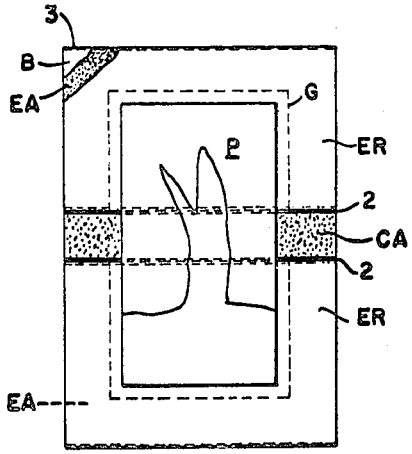
FIG. 6 is a plan view of a picture mount that includes a base support covered by a layer of adhesive that is protected on one surface from unintentional adhering contact by a release sheet that is divided into separately removable sections and with the adhesive omitted in channels at some of the edges of the release sheet sections.
Figure 7:
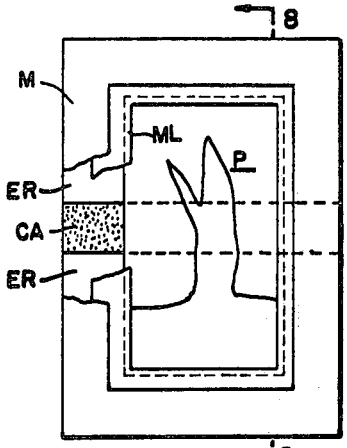
FIG. 7 illustrates the picture mount of FIG. 6 with a picture, mat, and mat liner attached to the adhesive exposed in the central portion of the mount by removal of the narrow release sheet section.
Figure 8:
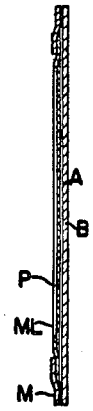
FIG. 8 is a vertical section through the mount, picture, mat liner, and mat of FIG. 7 after the various elements have been completely adhered to the mount.

FIGS. 6, 7 and 8 illustrate a mount that also may serve as a support for a picture, so that a picture can be mounted directly on a support and be ready for framing or other means of display, and embodies the same principle as the mounts of FIGS. 1 to 5 regarding the function of a narrow release sheet section. The mount includes an adhesive layer A with one surface covered by a release sheet R in separately removable sections, at least one section CR of which is narrow. The other surface of the layer of adhesive A is adhered to a base B. Guide lines G may be provided on the release sheet and/or on the base. The amount may be the same size as the picture P or it may be larger so that a mat M, mat liner ML, or other mounting elements can be secured to the adhesive that is exposed on the mount outside the area of the picture in the same manner and at the time the picture is secured to the mount.

In using the mount, a center section CR of the release sheet R is removed (FIG. 6), exposing the section of adhesive CA, and a picture P is positioned in the desired location on the mount by means of the guide lines G, after which the portion of the picture overlying the exposed adhesive CA is pressed into contact with the adhesive. Thereafter the mat liner ML is positioned in accurate alignment around the picture by means of the guide lines and adhered to the section of exposed adhesive CA, and then the mat M is located and adhered (FIG. 7). The remainder of the adhesive is exposed by raising the unadhered portions of the picture, mat liner ML, and mat M from one end of the mount, pulling one release sheet section ER from under the picture, mat liner and mat, and then progressively pressing the picture, mat liner, and mat into smooth contact with the one adhesive section EA, outwardly from the initially adhered portions after the one release sheet section ER is removed; the same procedure of removing the other release sheet section ER at the other end of the mount and pressing the remainder of the picture, mat liner and mat into smooth contact is accomplished to complete the assembly for display or for framing. If deemed desirable, the mount can be provided with a transparent base and transparent adhesive whereby the picture can be mounted on and be readable through the transparent base of the mount, thus protecting the picture and forming a laminated structure.

Figure 9:
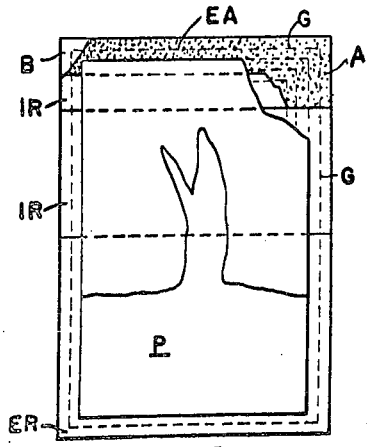
FIG. 9 is a plan of a mount having guide lines on the release sheet and registering guide lines on the base visible through the adhesive exposed by removal of an end release sheet section and showing a picture overlying the exposed and uncovered adhesive.

FIG. 9 shows a base B having guide lines G arranged thereon with the base covered with transparent adhesive A so that the guide lines G on the base B may be observable through the transparent adhesive. The adhesive is covered by release sheet sections ER, IR, IR and a removed end release sheet section ER exposing the end adhesive section EA. The picture P has sufficient ridigity to overlie the exposed adhesive EA without adhesively contacting such exposed adhesive due to the relative thickness of the adjacent release sheet section IR and the stiffness of the overhanging end portion of the picture. The picture is accurately located by means of the guide lines G on the remaining release sheet sections and the coinciding guide lines G on the base B to thereby accurately position the picture without contacting the adhesive. Thereafter the upper end of the picture is pressed into contact with the exposed adhesive and the release sheet sections IR, IR and ER are progressively removed in the manner previously described.

In FIG. 6 the adhesive sections EA, CA and EA have spaces or channels 2 between adjacent edges of the adhesive sections EA and CA and CA and EA. Also the adhesive in the end sections EA, EA does not extend completely to the ends of the base B leaving a rabbet 3 to thereby provide for ease of grasping the edges of the release sheet sections with the finger nails for facilitating easy removal of the release sheet sections since the unadhered edge portions of the release sheet section will extend away at a tangent from the base when the base is curved away from the release sheet in the manner shown in FIG. 10A.

FIGS. 1 to 3 show the cuts between adjacent edges of the release sheet sections on one surface staggered with respect to corresponding cuts through the release sections on the other surface thereby stiffening the mount shown in FIGS. 1 to 3 and this also serves to cause the edges of the release sheet sections on the outside of the curve to separate in the manner illustrated in FIG. 10 to thereby facilitate the removal of the various release sheet sections.

Although the foregoing description are explicit in terms of the drawings, it is obvious that various modifications in methods and means, some of which are indicated below, are possible.

Figure 10A:
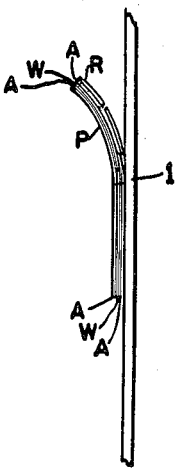
FIG. 10A illustrates how the edges of the release sheet sections on the back of the mount of FIGS. 1 to 5 inclusive move away from the adhesive layer when the picture and its mount are curved away from the support to facilitate removal of the remainder of the release sheet.

For example, when securing a relatively stiff picture to the mounts of FIGS. 1 to 5, it may be advantageous to apply the mount to the back of the picture rather than the picture to the mount, in the manner of mounting a picture on a support as illustrated in FIGS. 10 and 10A. Also, mats, mat liners, and other mounting elements may be secured to these mounts as in FIGS. 6 to 8.

The narrow release sheet section or sections of the mounts shown in FIGS. 6 to 8 may be at the end of the mount, rather than in the center, and the mat may be hingedly connected to the mount so that it automatically is in register with the mount.

The adhesive on the back of the picture in FIG. 11 need not be the pressure-sensitive adhesive of the mounts, but can be any suitable adhesive applied to the surface, with material such as waxed paper used as the release sheet section ER.

The oversheet in FIGS. 14 to 18 can be release sheet material and the adhesive on the back of the picture can be any adhesive.

The guide lines of the mounts and on the oversheets may be in the form of rectangles, squares, circles, ovals, grids, or combinations thereof or of any other shape for properly locating pictures, mat liners, mats, and other mounting elements on picture mounts and mounting boards and other supports.

The location of the guide lines G in FIG. 4 generally to one end and one side edge of the mount provides for aligning the other end and other edge of the picture along the corresponding end and edge of the mount and the trimming by scissors S will require only two cuts.

It will be apparent that various changes may be made within the spirit of the invention as defined by the valid scope of the claims.

What is claimed is:

1. An adhesive picture mount for mounting pictures or the like comprising a base of a size to accommodate a picture to be mounted with or without a surrounding mat, a layer of pressure sensitive adhesive is provided on at least one face of the base for securing a picture to the mount, and a cover release sheet releasably retained on the adhesive, said cover release sheet comprising at least three separable sections each release sheet section extending completely across the mount and being removable as a unit to expose a section of the underlying adhesive, one of said release sheet sections being narrow and of a width so as to expose only a minor portion of the pressure sensitive adhesive in a narrow section completely across the base upon a removal of the one sheet section, the remaining sheet sections being so orientated relative to said one sheet section, and hence the adhesive section exposed by the removal thereof, as to retain an overlying picture supported thereon out of direct pressure contact with the exposed adhesive section until such time as the picture is manually depressed below the plane of the remaining sheet sections and into direct contact with the exposed adhesive section for securemnt thereto whereby the picture and mount can be moved relatively to each other in overlying relation for accurate positioning until in final desired position, said exposed adhesive section being of a width so as to accommodate a manually depressed portion of the picture, said remaining sheet sections being removable subsequent to securement of the picture to the exposed adhesive section.

2. An adhesive picture mount in accordance with claim 1 including means on the mount for guiding the picture to assist in the desired orientation of the picture on the mount.

* * * * *